US005938407A

United States Patent [19]

Garrett

[11] Patent Number: 5,938,407

[45] Date of Patent: Aug. 17, 1999

[54] BATTERY DRIVEN BACKUP SYSTEM FOR AN AIR DISTRIBUTION FAN

[76] Inventor: Donald C. Garrett, 2142 Westbrook Rd., Seneca Falls, N.Y. 13148

[21] Appl. No.: 08/901,272

[22] Filed: Jul. 28, 1997

[51] Int. Cl.[6] ..... F04B 9/00

[52] U.S. Cl. ..... 417/16; 417/374; 416/170 R

[58] Field of Search ..... 417/16, 374; 416/170 R

[56] References Cited

U.S. PATENT DOCUMENTS 1,601,934 10/1926 Welch .

3,477,637 11/1969 Johnson ..... 230/214

*Primary Examiner*—Charles G. Freay

*Assistant Examiner*—Ehud Gartenberg

*Attorney, Agent, or Firm*—Brown, Pinnisi & Michaels, P.C.

[57] ABSTRACT

A backup system for powering a fan that engages in the event of primary power loss. The system includes a backup motor run by an alternate power source and controlled by a backup circuit. When primary power is lost, a solenoid is de-energized, depressing a microswitch and completing the backup circuit to the alternate power source. The backup motor rotates into contact with the fan to ensure uninterrupted airflow. This backup system is especially suited for powering an air distribution fan that ensures sufficient oxygen reaches a coal fire burning within a coal stove, thus maintaining the coal fire until primary power is restored. This backup system is readily adapted to typical coal-burning stoves in addition to other devices.

10 Claims, 2 Drawing Sheets

BATTERY DRIVEN BACKUP SYSTEM FOR AN AIR DISTRIBUTION FAN

FIELD OF THE INVENTION

This invention relates to a system for rotating a fan via a backup motor that is switched on if current from a primary power supply to a primary motor is interrupted, and in particular, to a backup system for the air distribution fan in a furnace.

BACKGROUND OF THE INVENTION

Furnaces such as coal burning stoves remain a widely used method of space heating in both urban and rural areas. In order for a coal fire to burn, the fire must be provided with an adequate supply of oxygen (oxygenation). Natural draft is too unpredictable to serve as a reliable method of oxygenating a coal fire. A fan promotes oxygenation of the coal fire by one of two methods. In one method, the fan blows fresh air into the coal fire (forced draft). Forced draft fans typically blow air upward from beneath the coal fire to create a higher rate of burning and thus allow for the use of a cheaper, lower grade of coal. In a second method, the fan exhausts oxygen-poor air from the coal fire, consequently drawing in fresh air (induced draft). Induced draft fans typically are installed in a flue outlet and must be capable of withstanding the high temperatures of coal exhaust. In either application, the fans allow the operator to control the rate at which coal burns within the stove by controlling the amount of fresh air available to the coal fire.

A drive shaft of the fan is typically turned by a 120 volt alternating current (AC) motor. The AC motor is usually connected to an external primary power supply such as commercial power. It is widely known that commercial power supplies and distribution systems are prone to occasional malfunctions, especially in inclement weather. During the winter, when the need for heating is greatest, power outages prevent the fan from oxygenating the coal fire, causing the fire to bum itself out. This necessitates restarting the fire once power is restored, which is a cumbersome and time-consuming process. Depending on the duration of the power outage, occupants of the heated space are seriously inconvenienced, and in the extreme, the health of the occupants is adversely affected and damage occurs to water pipes and other temperature-sensitive areas of the space.

An early attempt to provide a backup motor system is disclosed in Welch, U.S. Pat. No. 1,601,934. A loss of power triggers brushes to contact a commutator in a DC powered backup motor. An unspecified electroresponsive means for triggering the backup power system is disclosed. In addition, the invention disclosed relies upon the mechanical connection of the primary motor and the backup motor. This is also an undesirable arrangement because the backup assembly impedes the efficient working of the primary motor assembly under normal conditions. Also, this method requires a special brush arrangement, thus precluding the use of an off-the-shelf motor.

SUMMARY OF THE INVENTION

The present invention provides a backup system for powering a fan in the event of primary power loss. The system includes a backup motor run by an alternate power source and controlled by a backup circuit. When primary power is lost, a solenoid is de-energized, depressing a microswitch and completing the backup circuit to the alternate power source. The backup motor rotates into contact with the fan to ensure uninterrupted air flow. This backup system is especially suited for powering an air distribution fan that ensures sufficient oxygen reaches a coal fire burning within a coal stove, thus maintaining the coal fire until primary power is restored. This backup system is readily adapted to typical coal-burning stoves in addition to other devices.

DESCRIPTION OF THE PREFERRED EMBODIMENT

Figure 1:
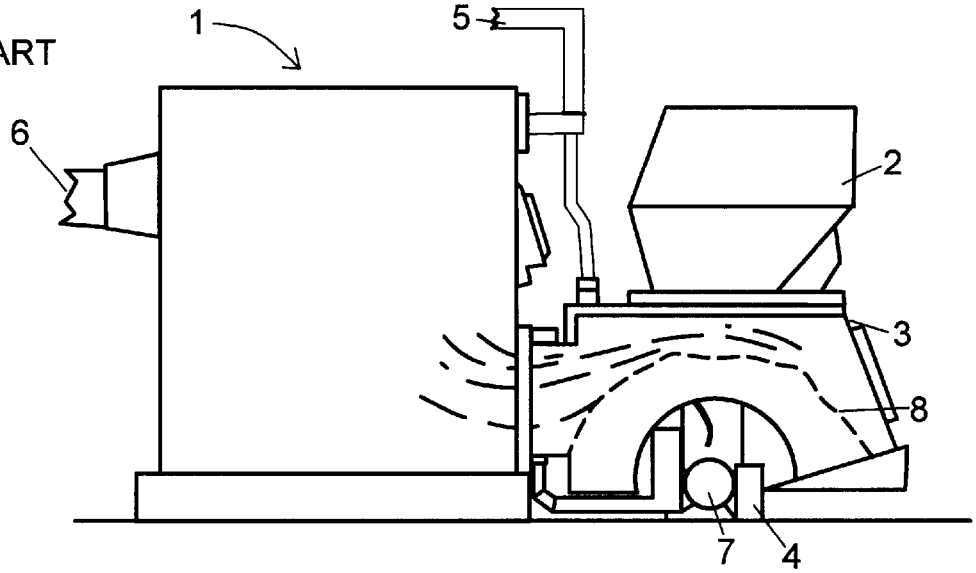
Fig. 1 PRIOR ART
FIG. 1 shows a plan view of a typical coal burning furnace including a forced draft fan.

Although the invention is described in terms of fans for furnaces, it will be understood that the invention is equally applicable to any motor powered by a primary power supply, such as cooling fans, refrigerator compressors, etc. FIG. 1 shows a typical coal furnace 1, in this case a Copperad-type furnace. Coal from fuel hopper 2 is burned within a chamber 3 by a coal fire 8. Oxygen-rich air is typically drawn into furnace 1 through an intake vent 5. This air is forced into chamber 3 by a fan such as forced draft fan 4, oxygenating the burning coal. Although this embodiment is described with a forced draft fan, it is equally applicable to a furnace using an induced draft fan. Forced draft fan 4 is typically powered by a 120 V AC motor 7 connected to a primary power supply, such as the residential AC power line (not shown). Gases created by the burning coal are exhausted through a flue vent 6.

Figure 2:
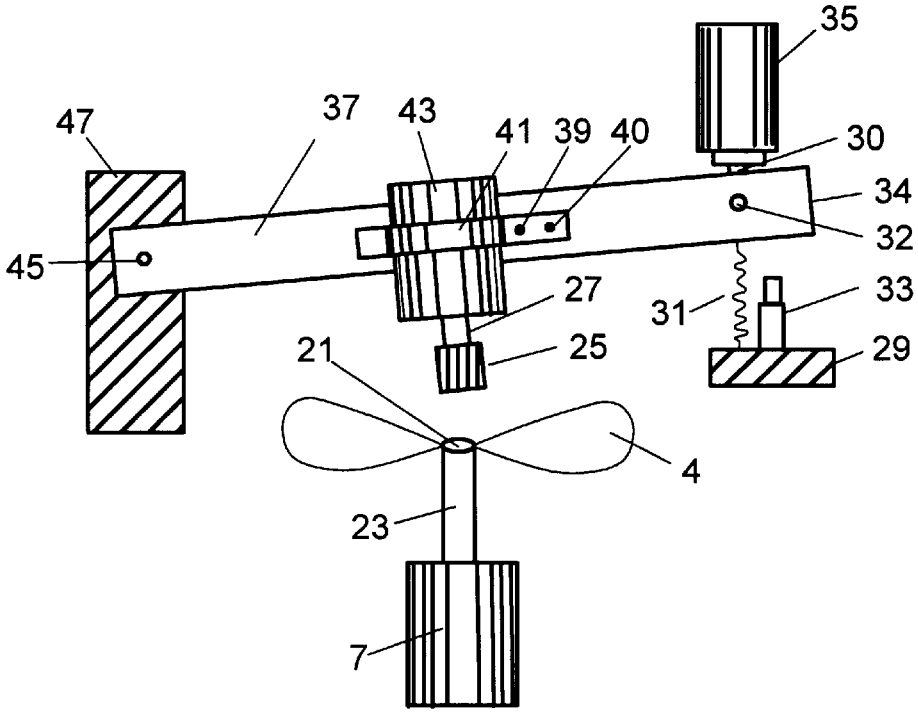
FIG. 2 shows a longitudinal plan view of the backup system shown while current from a primary power source remains uninterrupted in relation to an existing forced draft fan assembly.
Figure 3:
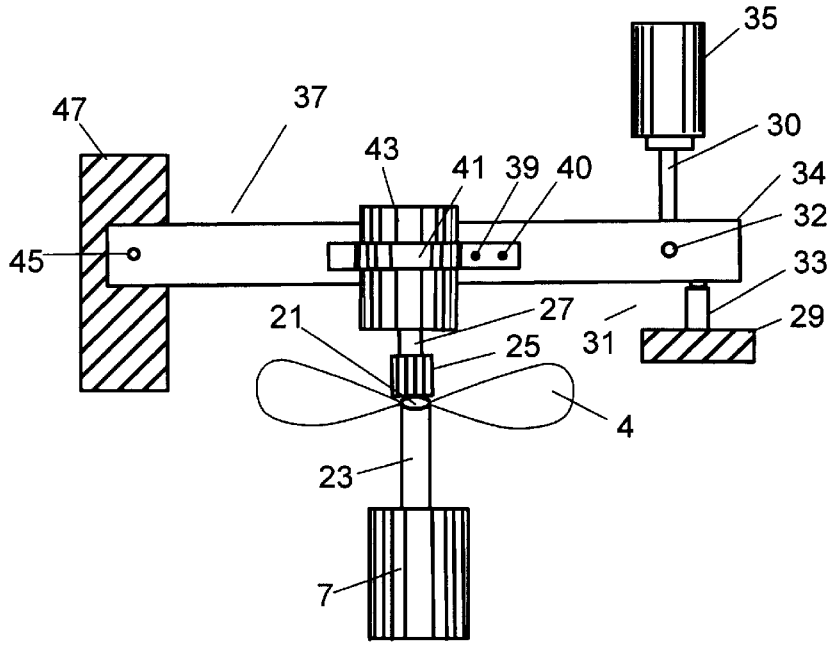
FIG. 3 shows a longitudinal plan view of the backup system in operation after the current from the primary power source has been interrupted.

Referring to FIGS. 2 and 3, current from the primary power supply (see FIG. 4) flows to primary motor 7. Motor 7 rotates a fan shaft 23 connected to fan 4. Since fan shaft 23 is connected to fan 4, when fan shaft 23 rotates, so does fan 4. Fan 4 blows air upward, feeding oxygen-rich air to coal fire 8. Current from the primary power supply also flows to a solenoid 35 energized by the same power source supplying motor 7. Solenoid 35 thus has current flowing into it so long as current from the primary power supply is flowing to primary motor 7.

When solenoid 35 is energized, it generates a magnetic field that exerts an attractive force upon a plunger 30. Plunger 30 is attached to a backup arm 37 at a plunger end 34 by a screw 32. Thus, plunger end 34 is held in close proximity to solenoid 35 when solenoid 35 is energized. Plunger end 34 is positioned above a microswitch 33 as long as the flow of current from the primary power supply to solenoid 35 is uninterrupted. With microswitch 33 released, a backup circuit (not shown) consisting of a backup power supply (not shown) and a 12 V DC motor 43 is open, i.e., not connected.

Backup arm 37 includes a secondary motor 43 which is preferably a DC motor. Secondary motor 43 rotates a backup shaft 27 which is attached to a coupler 25. Secondary motor 43 is held firmly to backup arm 37 by a motor bracket 41, which is secured to backup arm 37 by fasteners such as motor bracket screws 39 and 40. Backup arm 37 is preferably attached to an arm support 47 by a screw 45 such that backup arm 37 rotates about screw 45. One end of a spring 31 is attached to a spring support 29 and another end is attached to plunger end 34. A force is exerted upon plunger end 34 of backup arm 37 due to tensile pull of spring 31. This force is smaller in magnitude than the force generated by solenoid 35. Therefore, spring 31 remains in tension so long as the flow of current from the primary power supply to solenoid 35 is uninterrupted.

When the current flowing to AC motor 7 is interrupted, solenoid 35 becomes de-energized. Since the pull of spring 31 is now unopposed by the pull of solenoid 35, spring 31 pulls plunger end 34 away from solenoid 35, thereby causing coupler 25 to make firm contact with fan end 21. Coupler 25 preferably has a reusable sticky substance on its end that improves the connection but does not permanently bond coupler 25 to fan end 21. A rubber-like substance, such as silicone sealant, is suitable. In addition, microswitch 33 is depressed, completing the backup circuit. The backup power supply then supplies a current through the backup circuit which powers motor 43. Motor 43 rotates fan shaft 23, turning fan 4, thereby restoring the flow of air to the furnace.

When commercial power is restored, solenoid 35 re-energizes, rotating backup arm 37 against the force of spring 31, thus causing plunger end 34 to release microswitch 33 so that the backup circuit which powers backup motor 43 is disconnected. At the same time, backup arm 37 pulls backup motor 43 away from fan 4, allowing fan 4 to be driven once again by motor 7 operating off the primary power supply. At this point, the backup system is again ready to respond to a primary power outage.

Figure 4:
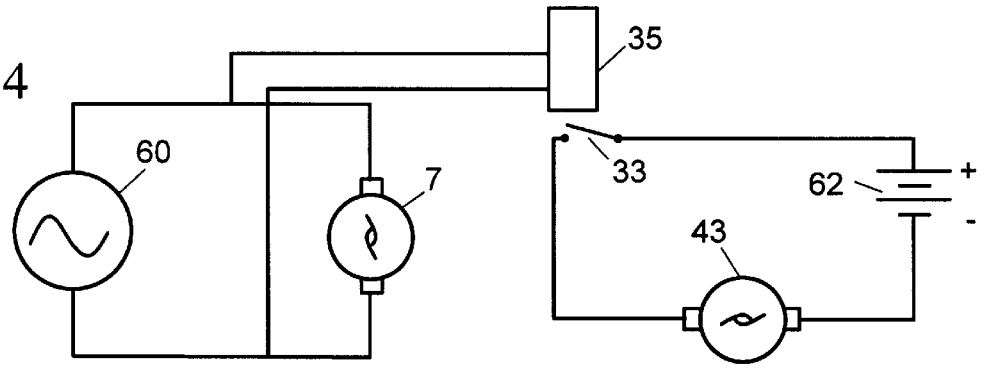
FIG. 4 shows a circuit diagram of the backup system in relation to the electrical components of the existing system when primary power remains uninterrupted.

FIG. 4 shows a circuit diagram of the preferred embodiment. Primary power supply 60 is connected to primary motor 7. Primary power supply 60 is preferably also connected to solenoid 35. It should be noted that microswitch 33 is shown open; thus, the primary power source is uninterrupted. When current from primary power supply 60 is interrupted, solenoid 35 is de-energized, releasing backup arm 37 (see FIGS. 2 and 3) and closing microswitch 33. Once microswitch 33 is closed, backup power supply 62 provides power to backup motor 43. Backup motor 43 then is positioned by backup arm 37 such that motor 43 rotates fan 4 as described above.

It will be recognized by one skilled in the art that if needed the backup motor 43 could be mounted at a slight angle to the arm 37, so that as the arm 37 is pivoted, the shaft 27 of the backup motor 43 will meet the shaft 23 of the primary motor 7 in proper alignment.

In an alternative embodiment, microswitch 33 is mounted on a side of plunger end 34 away from solenoid 35 with the backup circuit activated when microswitch 33 is depressed.

In an alternative embodiment, microswitch 33 is mounted on a side of plunger end 34 facing solenoid 35 with wires running to the backup circuit. Microswitch 33 is then depressed when plunger end 34 makes contact with solenoid 35. Thus, when commercial power is interrupted, microswitch 33 is released. The operation of backup arm 34 and solenoid 35 in this alternative embodiment is the same as in the preferred embodiment.

Figure 5:
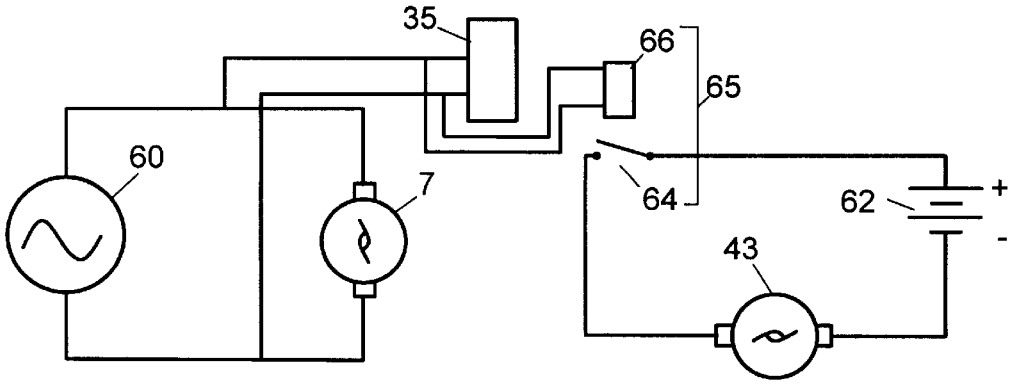
FIG. 5 shows a circuit diagram of an alternative embodiment of the backup system that uses a relay to activate the backup system. The system is shown in relation to the electrical components of the existing system when primary power remains uninterrupted.

In an alternative embodiment shown in FIG. 5, the backup system is preferably activated by a typical electrical relay instead of a microswitch. As in the preferred embodiment, a primary AC power supply 60 is connected to primary motor 7 that rotates a fan 4 (see FIGS. 2 and 3). Primary power supply 60 is preferably also connected to solenoid 35 and a typical relay 65. Relay 65 is shown as having normally open contacts. Thus, when current from the primary power supply 60 is interrupted, energizing circuit 66 de-energizes, closing a contact 64. When contact 64 is closed, a backup power supply 62 provides power to a backup motor 43. The operation of backup arm 34 (see FIGS. 2 and 3) in bringing a backup motor 43 into contact with the fan is the same as in the preferred embodiment.

It will be understood by one skilled in the art that while the invention has been shown and described herein with the backup motor 43 mounted on a pivoting arm 37, the arm could also be moved linearly on slides within the teachings of the invention.

Accordingly, it is to be understood that the embodiments of the invention herein described are merely illustrative of the application of the principles of the invention. Reference herein to details of the illustrated embodiments are not intended to limit the scope of the claims, which themselves recite those features regarded as essential to the invention.

What is claimed is:

1. A backup system for rotating a fan connected to a primary rotation means for rotating said fan, said primary rotation means being powered by a primary power source, comprising:

backup rotation means for rotating said fan powered by a secondary power source;

means for bringing said backup rotation means into contact with said fan when the primary power source powering said primary rotation means is interrupted; and means for connecting said backup rotation means to said secondary power source upon the interruption of the primary power source.

2. A backup system according to claim 1, wherein said backup rotation means is a DC motor.

3. A backup system according to claim 1, wherein said means for bringing said backup rotation means into contact with said fan comprises:

a pivot arm;

said backup rotation means being mounted on said pivot arm; and a spring forcing said pivot arm toward said fan; and electrically powered means for biasing said pivot arm away from said fan, against the force of said spring, operatively connected to said primary power supply, such that upon interruption of the primary power source, the spring forces the pivot arm towards the fan.

4. A backup system according to claim 3, further comprising means, attached to said backup rotation means, for coupling said backup rotation means to said fan.

5. A backup system according to claim 3, wherein said means for connecting said backup rotation means to said secondary power source comprises an electrical relay that completes a backup circuit when current to said primary rotation means is interrupted.

6. A backup system according to claim 3, wherein said electrically powered means comprises:

a solenoid;

said solenoid being energized when connected to said primary power supply, such that the force of said solenoid on said pivot arm opposes the force of said spring on said pivot arm; and said force of said solenoid being greater than said force of said spring when said solenoid is energized.

7. A backup system according to claim 6, further comprising:

an electrical switch having a closed position which completes a backup circuit between said backup rotation means and said secondary power supply and a open position which opens said backup circuit;

said pivot arm rotating to a first position when said solenoid is energized;

said pivot arm rotating to a second position by action of said spring when said solenoid is de-energized; and said electrical switch being coupled to said pivot arm such that said switch is in said open position when said pivot arm is in said first position and said switch is in said closed position when said pivot arm is in said second position.

8. A backup system for rotating a fan connected to primary rotation means for rotating said fan, comprising:

a solenoid;

a pivot arm being in a first position when said solenoid is in an energized state and said pivot arm being in a second position when said solenoid is in a de-energized state;

a motor attached to said pivot arm;

a coupler connected to a shaft of said motor;

a spring acting in opposed relationship to a pull of said solenoid;

a switch;

an end of said pivot arm depressing said switch when said pivot arm is in said second position and releasing said switch when said pivot arm is in said first position;

said coupler contacting said fan when said pivot arm is in said second position; and said motor being activated when said pivot arm is in said second position.

9. A backup system for rotating a fan according to claim 8, wherein:

said coupler is out of contact with said fan when said pivot arm is in said first position; and said motor is deactivated when said pivot arm is in said first position.

10. A backup system for rotating a fan connected to primary rotation means for rotating said fan, comprising:

a solenoid;

a switch;

a pivot arm;

an end of said pivot arm releasing said switch when said solenoid is energized;

a spring acting in opposed relationship to a pull of said solenoid;

said end of said pivot arm depressing said switch due to a force of said spring when said solenoid is de-energized;

a motor attached to said pivot arm;

a coupler connected to a shaft of said motor;

said coupler contacting said fan when said solenoid is de-energized; and said motor being activated when said solenoid is de-energized.

* * * * *